US006939186B1

(12) United States Patent
Kuckes

(10) Patent No.: US 6,939,186 B1
(45) Date of Patent: Sep. 6, 2005

(54) ROLLING HEEL, FORWARD FACING ROWING SYSTEM

(75) Inventor: Arthur F. Kuckes, Ithaca, NY (US)

(73) Assignee: Vector Magnetics, Inc., Ithaca, NY (US)

( * ) Notice: Subject to any disclaimer, the term of this patent is extended or adjusted under 35 U.S.C. 154(b) by 17 days.

(21) Appl. No.: 10/961,055

(22) Filed: Oct. 12, 2004

Related U.S. Application Data

(60) Provisional application No. 60/570,824, filed on May 14, 2004.

(51) Int. Cl.[7] ..... B63H 16/06
(52) U.S. Cl. ..... 440/104; 440/102
(58) Field of Search ..... 440/102, 104, 440/105

(56) References Cited

U.S. PATENT DOCUMENTS

| | | | |
|---|---|---|---|
| 88,013 | A | 3/1869 | Connor |
| 282,121 | A | 7/1883 | Rutter |
| 371,103 | A | 10/1887 | Smith |
| 387,743 | A | 8/1888 | Smith |
| 554,589 | A | 2/1896 | Forward |
| 4,383,830 | A | 5/1983 | Cartwright |
| 5,127,859 | A | 7/1992 | Rantilla |
| 5,163,857 | A | 11/1992 | Hinsley |
| 5,215,482 | A | 6/1993 | Henry |
| 5,630,739 | A | 5/1997 | Mele |
| 5,647,782 | A | 7/1997 | Henry |
| 5,685,750 | A | 11/1997 | Rantilla |
| 5,833,256 | A | 11/1998 | Gilmore |
| 5,873,757 | A | 2/1999 | Van Balen |
| 5,938,489 | A | 8/1999 | McNeil |
| 6,095,878 | A | 8/2000 | Van Balen |
| 6,109,988 | A | 8/2000 | Dunn, Jr. |
| 2004/0043679 | A1 | 3/2004 | Fernandez |

OTHER PUBLICATIONS

"FrontRower forward facing rowing" (Exercise you can look forward to) www.frontrower.com/index.htm Aug. 11, 2004.

*Primary Examiner*—Jesus D. Sotelo
(74) *Attorney, Agent, or Firm*—Jones, Tullar & Cooper, PC

(57) ABSTRACT

A new and improved leg assisted forward facing rowing system is disclosed wherein a rower applies leg power to propel a boat by means of a rope connected between his or her foot and an oar. A unique feature is a roller, fastened under the heel of the rower's foot, that rolls along the bottom of the boat supporting the weight of the rower's leg while the reciprocating motion of the leg is transmitted by rope going through pulleys to reverse the force applied to the oar. The oar is pivoted at the center of the boat above the rower's knees by a mechanism that includes provision for applying lifting force to support the oar weight thereby holding the oar blade out of the water when no force is applied. The rower's legs, back and arms simultaneously apply rowing force. Feathering at the end of a stroke and squaring action at the beginning are provided by wrist action to rotate the oar blade. Ergonomically good features of a conventional sliding seat racing scull rowing are thereby incorporated into a forward facing rowing apparatus.

32 Claims, 9 Drawing Sheets

ROLLING HEEL, FORWARD FACING ROWING SYSTEM

This application claims the benefit of U.S. Provisional Application No. 60/570,824, filed May 14, 2004, the disclosure of which is hereby incorporated herein by reference.

BACKGROUND OF THE INVENTION

The ergonomics of conventional scull and shell rowing, where a rower's arms, legs and back apply propelling force to the oars, are very good. The rower grasps the oars with his hands while sitting on a sliding seat facing the rear of the boat with his feet fastened in boots on the bottom of the boat. At the start of the power part of the stroke, the seat is located toward the rearward end of its motion with the rowers legs flexed, the rower lifts the oar handle to place the blade of the oar in the water, and the legs, then the back and finally the arms supply force to the oar as the rowers legs extend to slide the seat toward the forward end of its motion, propelling the boat forward. At the end of the stroke the rower uses wrist action to rotate the oar, thereby "feathering" it so that water force on the blade lifts the oar out of the water. The rower presses down on the oar handle to hold the oar out of the water during the recovery phase in which the rower legs are flexed to cause the seat to slide toward the rear of the boat. The momentum generated by moving the body and arms rearward toward the bootstraps brings the oar back to the starting position. Wrist action then rotates the oar blade, thereby "squaring" it, and upward arm motion then "plants" the oar in the water as the pulling force is once again applied.

A long-standing desire has been for a rowing apparatus which will incorporate these actions while the rower faces forward; i.e., faces in the direction in which the scull, shell, or other rowed vessel or boat is propelled. Facing forward is more pleasant and is better for keeping the boat on a proper course. Every backward facing rower has experienced serious safety concerns after encountering unexpected obstacles, even when mirror arrangements are used to look ahead.

Various attempts have been made in the prior art to provide a forward-rowing system, with varying success. For example, some rowing apparatus inventions disclose a sliding seat with feet fixed in bootstraps for leg assistance. Systems where the seat is fixed and the feet move can give better ergonomics, however, since the leg force transmitted to the oar need not go through the arms and back and the possibility of balancing the leg effort with that of the arms and back by separate connection to the oars becomes possible. Fixed seat systems may be found in the prior art. One such system provides footrests that slide in a track and are connected by ropes to oars in a normal, backwards facing rowboat, but this system does not require fastening of the feet to a foot support, does not have free foot movement, and more importantly does not have favorable foot ergonomics. In other systems, the entire oar rigging, including its full weight, must also be moved forward and backward with each stroke, thus increasing the required force and effort of the user. In still other systems, a configuration is provided where the feet rest on a swinging arm device to provide added power. The swinging arm motion has poor ergonomics, however, because of the unnatural relationship in the positioning and relative motion between the legs with the rest of the body. The principal focus of some devices is to provide a hands free rowing apparatus that automatically feathers, returns the oar to the starting position, squares it and finally lowers it into the water, whereupon force generated entirely by the legs is applied to the oars. Other prior art discloses a sliding foot support in a guiding track member to provide the transfer of leg effort by a complex pulley system to an oar movement mechanism. Such systems suffer from undue mechanical complications, with much inherent friction, and probable unreliability in a wet environment.

SUMMARY OF THE INVENTION

Briefly, and in accordance with the present invention, the difficulties encountered in prior front-facing rowing systems are overcome by the provision of a new and improved leg assisted system wherein a rower applies leg power to an oar by means of a flexible cable, or rope, connected to a platform, or shoe, such as a boot which is engaged by the rower's foot. The weight of the shoe and of the rower's foot is supported by a wheel or slider attached to the shoe, for example at the region of the rower's heel. The rower's leg reciprocates back and forth during the rowing strokes while his foot freely rolls or slides on the floor of the boat. The force generated by the rower's leg is transmitted through the shoe and the cable to the oar by way of the ball of the foot, as is the case with a sliding seat scull or bicycle pedal. The inner end of the oar is pivoted at the center of the boat, above the rower's knees, to allow back and forth and up and down oar movement. The weight of the oar is balanced by a spring so that the neutral point of the oar blade is a few inches out of the water. The oar has two coaxial, relatively rotatable segments with a rotational joint between the location of the pivot point and a handle to allow a simple wrist action to rotate the oar blade as required for oar feathering and squaring. The rower grasps the oar using the handle which is loosely connected to the oar, to impart the needed actions of pulling and pushing the oar and also of feathering, squaring and raising and lowering the oar out of and into the water.

More particularly, the rowing system of the invention includes an oar having a first, or inner, portion pivotally mounted on a pivot support and a second portion coaxial with and rotatable with respect to the first portion, a handle pivotally secured to the second portion; a stationary seat for a rower, and a movable foot-operated shoe connected to the handle by a flexible cable or rope extending through one or more pulleys. The pivot support preferably comprises a horizontal platform supported in front of the seat by a bridge structure or by a cantilever, and incorporates a tower supported for rotation in the platform. A horizontally extending pivot bracket is fixed to the tower and supports the oar on a pivot pin for motion in a vertical plane, with rotation of the tower permitting pivotal motion of the oar in a horizontal plane. The pivot pin is spaced from the inner end of the oar, and the inner end is secured to a yoke having a vertical shaft that extends into the tower. A coil spring surrounds and is adjustably secured to the shaft to counterbalance the weight of the oar so that it normally is supported in a generally horizontal rest position.

The handle includes a rod portion that is pivotally engaged at one end to the oar and is secured at its opposite end to the flexible cable. A grip is secured to the rod at an angle of about 60° to allow a rower to grasp the handle to manipulate the oar in forward (recover) and rearward (power) strokes. The pivotal connection of the handle also allows the rower to pivot the handle in one direction to rotate the oar to feather it for the return stroke and to pivot the handle in the opposite direction to rotate the oar to square it for the power stroke by simple wrist motions in synchronism with the foreward and rearward motion of the oar.

The movable shoe which is engaged by the foot of the rower is moved forward and back in synchronism with the power and return strokes, respectively, of the oar, with the cable being connected to the shoe by way of a suitable harness to transfer the motion of the shoe to the oar. The shoe may be in the form of a boot, a sole plate, or other similar structure that receives and secures the rower's foot to permit a transfer of power from the rower's leg to the oar. The shoe preferably includes a set of wheels or rollers of nylon or similar material at the heel region to support the rower's leg, allowing the shoe to roll back and forth on a floor surface during rowing. Tracks may be provided on the floor surface to guide this reciprocating motion. Wheels may also be provided at the toe end of the shoe, if desired. Alternatively, sliders in the form of stainless steel tubes or nylon slides may be mounted on the shoe to engage the floor surface or tracks.

The shoe is connected to the oar by way of a cable passing over one or more pulleys mounted, for example, behind the seat. The cable extends from the shoe, back under the seat, through the pulleys, and forward to the oar handle so that forward motion of the shoe produces rearward motion of the handle and oar during the power stroke.

The system may be constructed in any rowable vessel, such as a scull, shell, rowboat or canoe, and thus fabricated as a permanent part of the vessel. Alternatively, the system may be constructed as an insert, in which case it is constructed as a unitary front-rowing assembly that can be mounted in and removed from a suitable vessel. Although the system has been described above in terms of a single oar, it will be understood that in most instances it will be fabricated with two oars mounted at the centerline of the system for use by a single operator.

BRIEF DESCRIPTION OF DRAWINGS

The foregoing, and additional objects, features and advantages of the present invention will be more fully understood from the following detailed description of preferred embodiments thereof, wherein.

DESCRIPTION OF PREFERRED EMBODIMENTS

Figure 1:
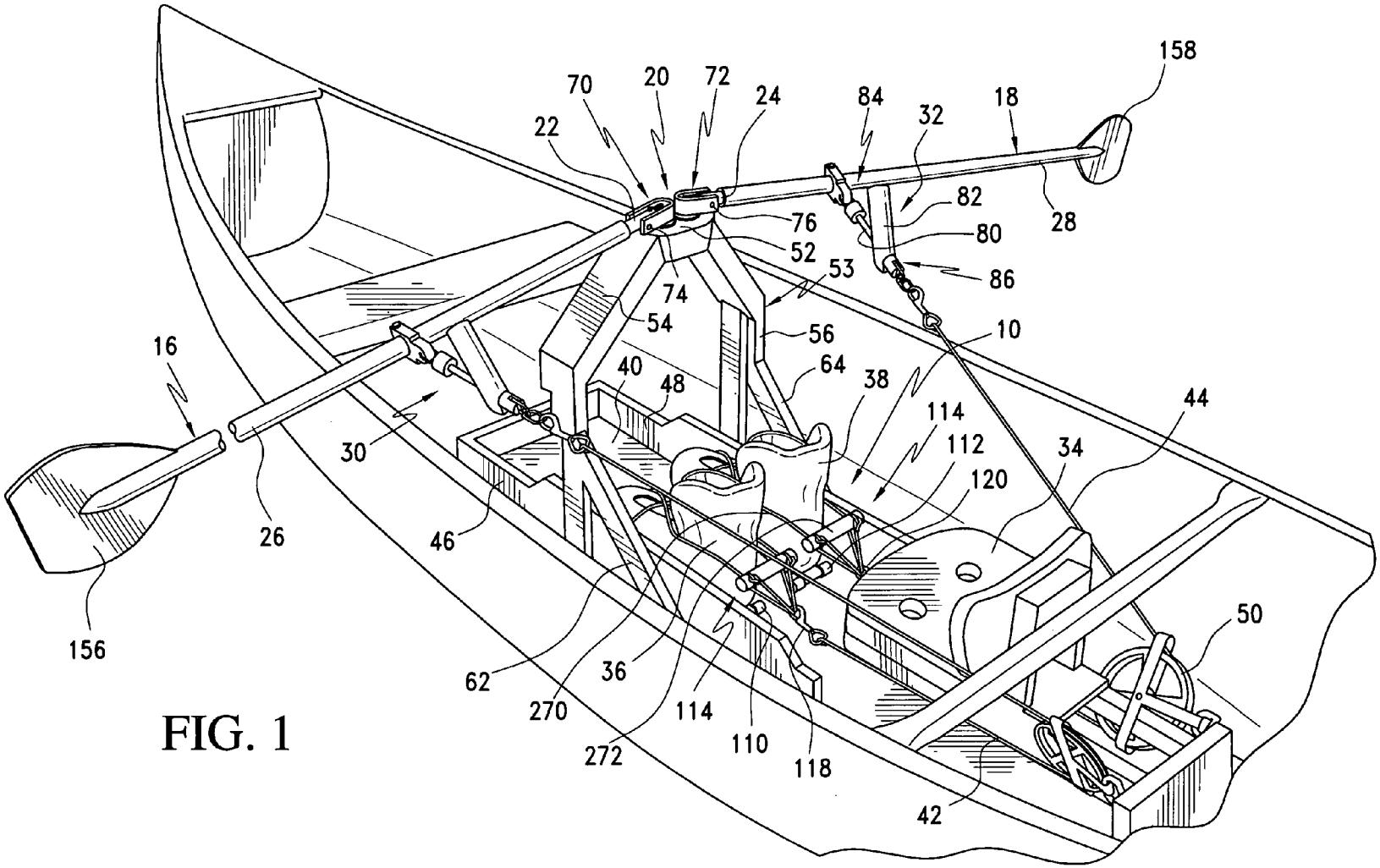
FIG. 1 is a perspective view of a preferred embodiment of the rowing system of the present invention.
Figure 2:
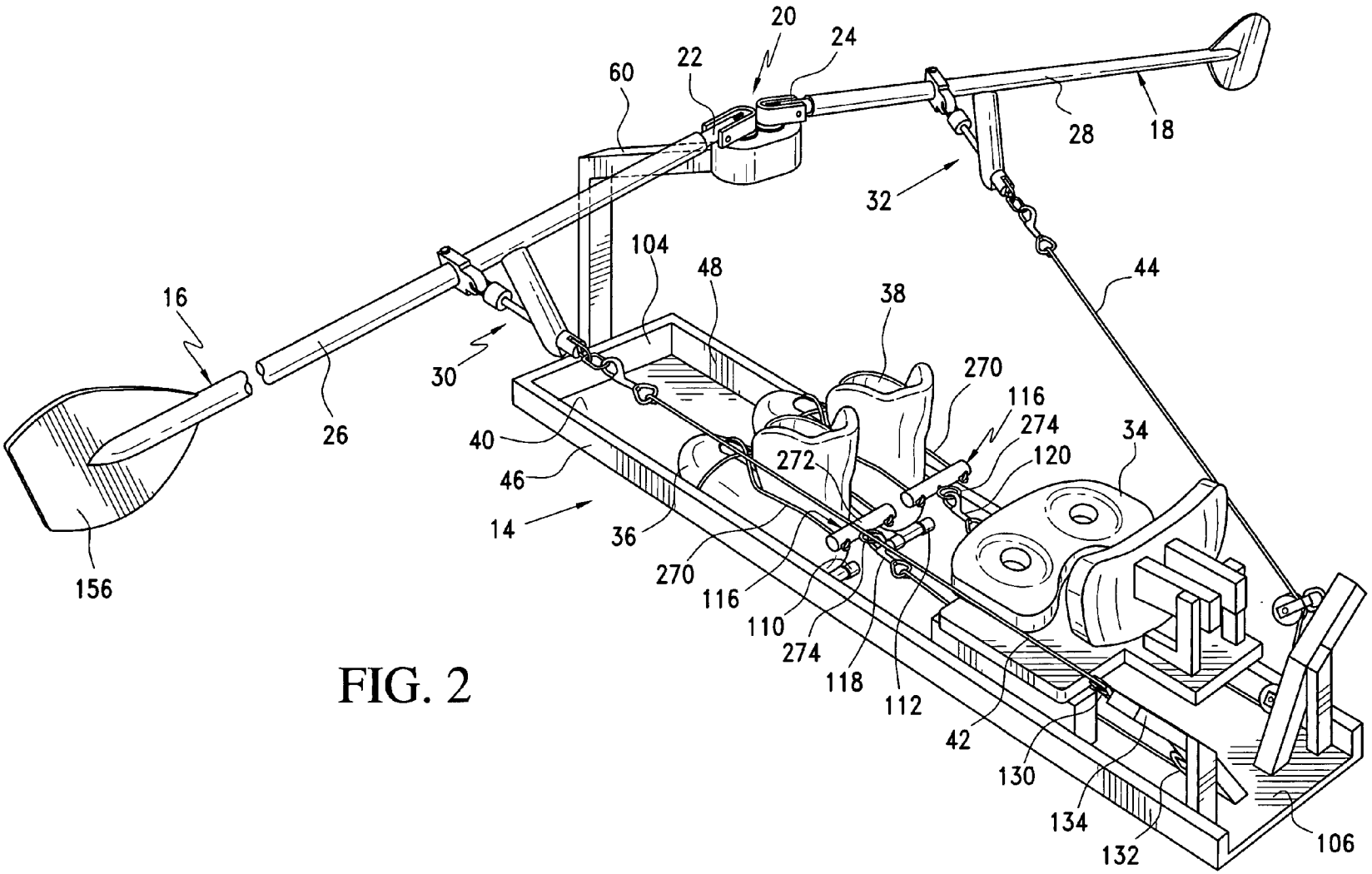
FIG. 2 is a perspective view of a second embodiment of the rowing system of the present invention.

Turning now to a more detailed description of the invention, FIG. 1 illustrates a first embodiment of a front-rowing system in the form of a unitary "drop in" rowing apparatus 10 mounted in a suitable boat hull 12. Although the boat hull is illustrated as a canoe, it will be understood that it may take any desired form, and that a canoe is illustrated for purposes of convenience. It will also be understood that for purposes of the following description, the system is illustrated as a unitary assembly capable of being mounted in any suitable boat hull, but that it is often preferable to incorporate the system of the invention as an integral part of the boat design. A second embodiment of the invention is illustrated in FIG. 2 at 14, wherein the forward-facing rowing apparatus incorporates a modified oar support apparatus, to be described in greater detail below. In both embodiments, similar features are identified by the same reference numerals.

The self-contained, or unitary, front facing rowing apparatus 10 of FIG. 1 includes a pair of oars 16 and 18 pivotally mounted at their inner ends on a pivot support generally indicated at 20. Oars 16 and 18 incorporate corresponding inner portions 22 and 24, respectively, and corresponding coaxial outer end portions 26 and 28, respectively, with the outer portions being relatively rotatable with respect to their inner portions about their common axes. Handles 30 and 32 are pivotally secured to the outer portions 26 and 28 of oars 16 and 18, respectively, for use in manipulating the oars during rowing. The rowing apparatus 10 further includes a stationary seat 34 for the rower located behind the pivot support 20, and a pair of movable, foot-operated shoes 36 and 38 located on the floor 40 of the apparatus in front of the seat. The shoes 36 and 38 are connected to the handles 30 and 32, respectively, through flexible cables, or ropes 42 and 44 which extend from the shoes back under the seat 34 and around suitable pulleys such as the pulley indicated at 50 in FIG. 1 and then forwardly to their corresponding handles.

The pivot support 20 preferably comprises a horizontal platform 52 supported in front of the seat by a bridge structure 53 that includes arms 54 and 56 secured to sides 46 and 48 of the insert assembly 10 and arching over the floor 40 in front of seat 34, meeting at platform 52 over the centerline of the boat hull 12. In the structure of FIG. 2, the arching bridge formed by arms 52 and 56 is replaced by a cantilevered arm 60 secured to the forward end of the insert 10 and extending rearwardly toward the seat to position the platform 20 in front of, and above the legs of, the rower. The arched bridge structure 53 is preferred since the arms 54 and 56 may be constructed to produce a stronger and more rigid support for the oars than is practical for the cantilever, as by the use of rearwardly extending braces 62 and 64, for example.

The inner ends 22 and 24 of the oars are supported for pivotal motion on platform 52 by means of corresponding U-shaped brackets 70 and 72, which are mounted to be pivotal about a vertical axis to allow forward and backward motion of the oars, with each oar being secured to its respective bracket by horizontal pins 74 and 76 to allow pivotal motion of the oars in a vertical direction.

Rotation of the outer portions 26 and 28 of the oars with respect to the coaxial inner portions 22 and 24 is accomplished by means of handles 30 and 32, wherein each handle incorporates a rod portion 80 and grip portion 82. The grip portion is secured to the rod at an angle of approximately 60° to enable a rower to grasp the grip portion and pivot the rod portion up and down by wrist action. The distal end of the rod portion 80 is connected to the outer portion of the oar through a pivotal connection 84, to be described in greater detail below, while the near end of the rod 80 is fastened through a connector 86 to the corresponding one of cables 42 or 44. This handle enables a rower to grasp the grip portion to move the oar back and forth horizontally and up and down vertically in a rowing motion while tilting the rod portion to controllably rotate the outer portion of the oar to control feathering and squaring of the oar blade in synchronism with the rowing motion. At the same time, the rower engages the shoes 36 and 38 with his feet to slide the shoes forwardly and rearwardly with respect to the stationary seat in synchronization with the rowing motion to assist in the power stroke of the oars.

As more clearly illustrated in FIG. 2, the rowing insert 10 of the present invention incorporates a floor portion 40 between side rails 46 and 48 and front and rear rails 104 and 106. Seat 34 is adjustably positioned on the side rails 46 and 48 and is secured in place by clamps, pins, or other suitable fasteners. As illustrated, the shoes 36 and 38 may be in the form of lace-up boots, and in accordance with the invention, the shoes incorporate corresponding wheels or rollers 110 and 112, preferably located in the heel region of the shoes. These rollers, which may be nylon wheels, for example, engage the floor 40 of the insert assembly 10 to enable the roller to easily move the boots forwardly and rearwardly during the rowing motion, with the rollers supporting the weight of the shoes and of the rollers' legs. Suitable harnesses 114 and 116 (FIGS. 1 and 2, respectively) are secured to the boots and are fastened to the connector cables 42 and 44, respectively, by corresponding fasteners 118 and 120.

It will be understood that if the rowing system of the invention is built into a boat hull, a separate floor 40 might not be needed, in which case the rollers would engage the interior surface of the hull in which the system is installed. As will be described in greater detail below, it may be desirable to mount guide tracks on either the floor 40 or the interior surface of the hull for receiving the rollers. Additionally, in some cases it may be desirable to replace the wheels with bars or plates which will slide along the insert floor or hull surface.

As further illustrated in FIG. 2, the cables 42 and 44 are directed rearwardly under the seat 34 to pass around a pair of pulleys such as the pulleys 130 and 132 provided for cable 42. These pulleys are secured to the rear rail 106 of the insert, with the pulley 132 being secured to an extension arm 134 which positions pulley 132 outwardly in closer alignment with the direction of motion of handle 30. Although the single pulley 50 illustrated in FIG. 1 may be used instead of pulleys 130 and 132, the configuration illustrated in FIG. 2 is preferred.

Figure 3A:
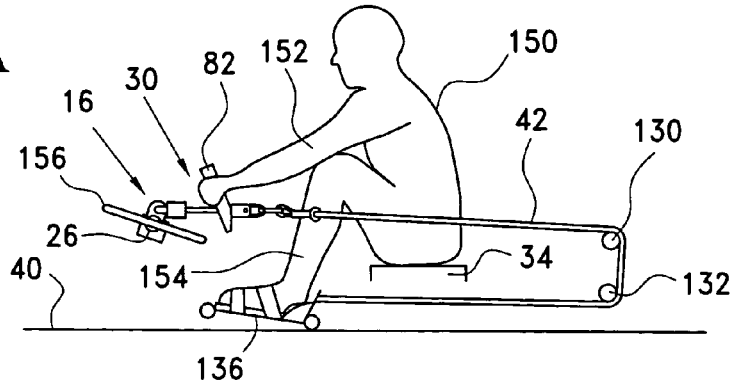
FIGS. 3A–3D are diagrammatic side view illustrations of the operation of the rowing system of the invention.

The operation of the front facing rowing system of the present invention is illustrated diagrammatically in FIGS. 3A through 3D, which show the rowing sequence in side view, and corresponding FIGS. 4A through 4D, which show the same rowing operation in a front view. To start the rowing sequence, an operator, or rower 150 positioned on stationary seat 34, pushes the oars 16 and 18 forwardly by leaning forward, extending his arms 152 and flexing, or retracting, his legs 154. The bending or flexing of the legs brings the shoes 36 and 38 back toward the seat 34, releasing the tension on cables 42 and 44 and allowing the oars to be moved forwardly by means of handles 30 and 32. As he moves to this position, the rower tilts his wrists upwardly to pivot the grips 82 in a clockwise direction, as illustrated in FIG. 3A, thereby pivoting the rods 80 upwardly, rotating the outer portions 26 and 28 of the oars in a counterclockwise direction (as viewed in the Figures) and feathering the blades 156 and 158 as the oars are moved forward.

Figure 3B:
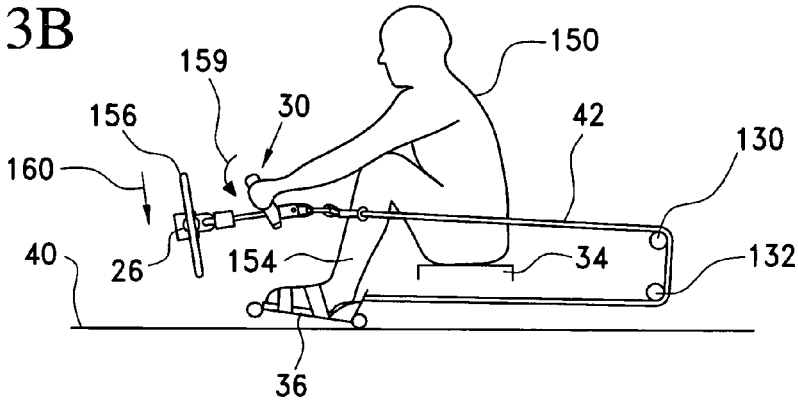
Figure 3C:
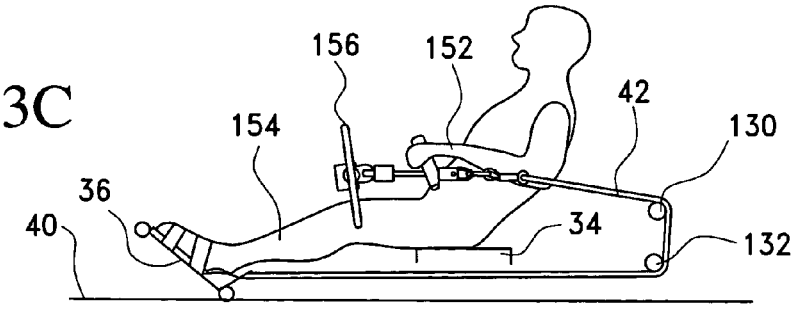

At the beginning of the power stroke, illustrated in FIG. 3B, the operator rotates his wrists downwardly to pivot the grips 82 in a counterclockwise direction, as indicated by arrow 159, thereby rotating the outer ends 26 and 28 of the oars in a clockwise direction to square the blades 156 and 158. The oars are then lowered, as indicated by arrow 160, to dip the blades below the level of the water, illustrated at 162 in FIG. 4B, and the power stroke begins. As illustrated in FIG. 3C, during the power stroke, the operator 150 pulls on the oars with his back, while simultaneously pressing on the shoes 36 and 38 with his legs and, as the end of the stroke is near, continues the power stroke by flexing, or bending, his arms. The motion of the shoes 36 and 38 in a forward direction transmits the power of the legs through cables 42 and 44 to the handles 30 and 32 and thus to the oars 16 and 18. By properly synchronizing the leg, back and arm motion, the maximum amount of power is applied to the oar during the power stroke.

Figure 3D:
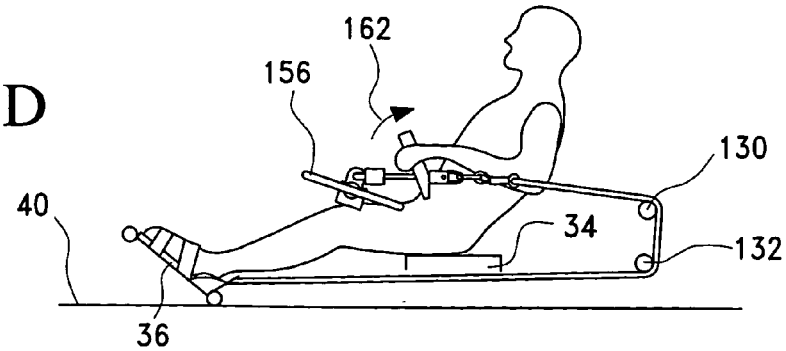
Figure 4A:
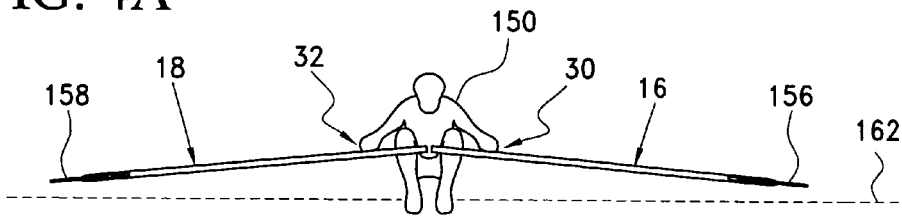
FIGS. 4A–4D are diagrammatic front views of the illustrations of FIGS. 3A–3D, respectively.
Figure 4B:
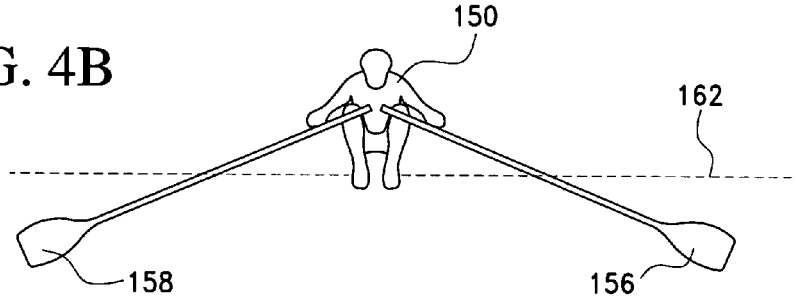
Figure 4C:
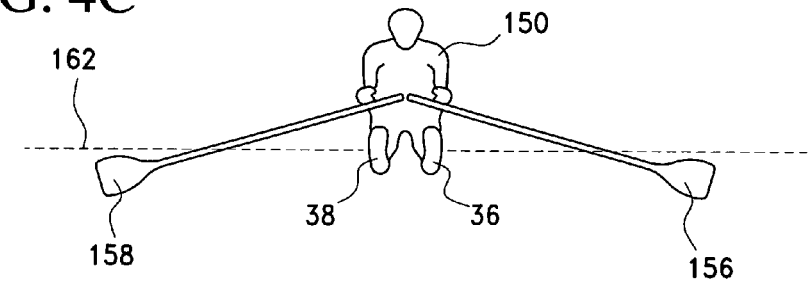
Figure 4D:
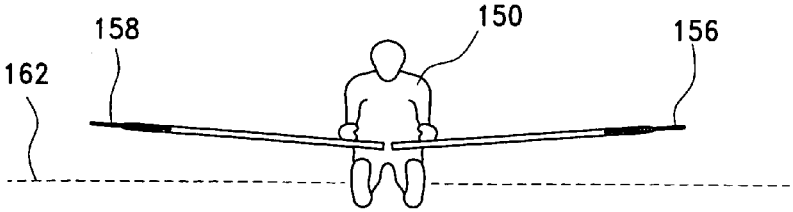

At the end of the stroke, illustrated in FIG. 3D, the wrists are tilted in a clockwise direction illustrated by arrow 162, as the oars are raised out of the water, to feather the blades 156 and 158 for the return stroke, which ends in the position illustrated in FIG. 3A. The pivoting of handle 30 is facilitated by the flowing of water past the boat, as the oar is lifted, thereby making the feathering motion a natural part of the rowing motion. Synchronization of the clockwise and counterclockwise rotation of the oar, produced by tilting the handle 30, with the forward and rearward motion of the oar during the return and power strokes provides an easy and natural motion for rowing.

Figure 6:
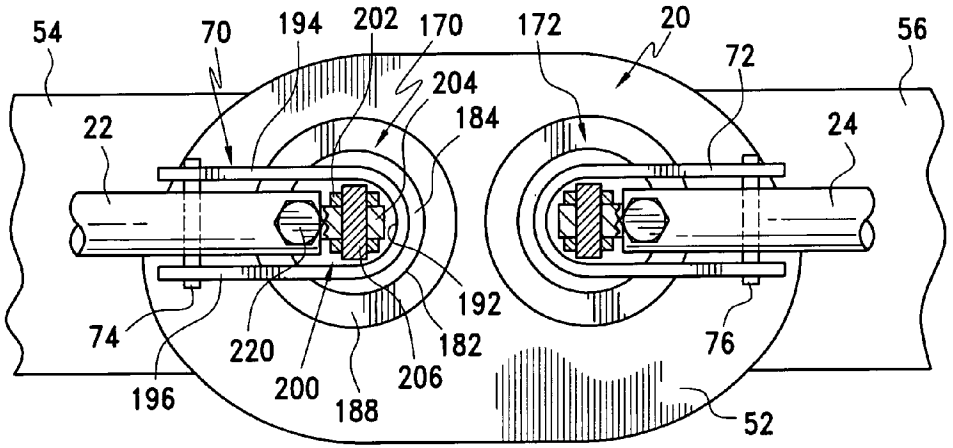
FIG. 6 is a top plan view of the pivot mounting of FIG. 5.
Figure 5:
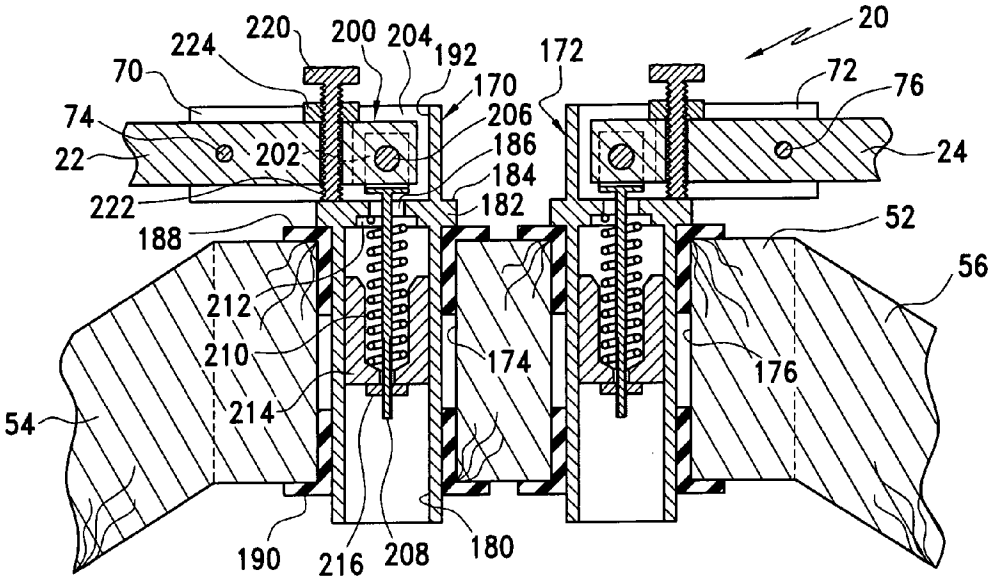
FIG. 5 is a partial cross-sectional view of the pivot mounting of oars utilized in the systems of FIG. 1 and FIG. 2.

The pivot support 20 shown in FIGS. 1 and 2 is illustrated in greater detail in FIGS. 5 and 6, to which reference is now made. The platform 52, which is supported by bridge arms 54 and 56, may be generally oval in shape, and may support a single oar, or as in the illustrated embodiment, may support a pair of oars 16 and 18 for pivotal motion, as discussed above. The oars are supported at their inner ends 22 and 24 by corresponding pivot towers 170 and 172, respectively, which are, in turn, supported in corresponding apertures 174 and 176 which extend vertically through the platform 52 at spaced apart locations. The pivot towers 170 and 172 are substantially identical, and thus will be described in what follows only with respect to tower 170. In the illustrated embodiment, pivot tower 170 consists of a tube 180 which is partially closed at its upper and by a top plate 182 having a diameter greater than the diameter of tube 180 to provide and outwardly-extending shoulder portion 184. The top plate also incorporates a central aperture 186 axially aligned with tube 180. The tube 180 is rotatably secured in aperture 174 by upper and lower bushings 188 and 190 having outwardly extending flanges and which are secured, as by a suitable adhesive, to the exterior surface of tube 180, with the top bushing 188 engaging the lower surface of shoulder portion 184. The tube 180 may be stainless steel, aluminum, or the like, with stainless steel being preferred, while the bushings 188 and 190 preferably are nylon. The bushings are spaced apart so that their flanges engage the upper and lower surfaces of platform 52 to secure the tube 180 in aperture 174 for rotation about a vertical axis.

The generally U-shaped bracket 70 is secured to the top plate 182 on tube 180, with the closed end 192 of the bracket surrounding aperture 186 and with generally parallel bracket arms 194 and 196 extending in a horizontal direction and opening outwardly to receive the inner end 22 of oar 16. Inner end 22 is mounted on pivot pin 74 which extends through the oar and is secured in the arms 194 and 196 of bracket 70, with the pin being spaced away from the axis of tube 180 and permitting pivotal motion of the oar 16 in a vertical plane. This pivotal motion is dampened by means of a yoke 200 having a U-shaped bracket portion 202 having upwardly extending spaced arms which receive the innermost end 204 of oar 16. The yoke, which is pivotally secured to the oar by a pin 206, includes a vertical stem 208 that extends through aperture 186 and axially into the interior of tube 180. A coil spring 210 surrounds the stem 208, with the upper end of the spring engaging a recess 212 in the lower surface of plate 182 for centering the spring. The lower end of the spring engages a generally cylindrical receiver cup 214 slideably mounted within the interior of tube 180 to center the spring within the tube. A threaded lower end of stem 208 threaded extends through the receiver 214, with an adjustment lock nut 216 on stem 208 being movable to engage the lower surface of receiver 214. Loosing or tightening of lock nut 216 on stem 208 lowers or raises the receiver 214 to adjust the compression of spring 210. The spring is adjusted to counterbalance the oar 16 about pivot point 74 and preferably is adjusted so that when the oar is at rest, the blade 156 (FIG. 1) is slightly above the water level when the system is at rest. The up and downward motion of the innermost end 204 of the oar is limited by an adjustment bolt 220 which is threaded through the oar so that its lower end 222 engages the upper surface of plate 182. The bolt can be secured in its adjusted position by a lock nut 224.

The pivot tower 170 thus provides a simple yet effective mounting for the oar 16 to provide pivotal motion of the oar 16 in a vertical plane about pin 74, with the downward motion of the innermost end 204 being limited by adjustment bolt 220. The tower also provides unlimited pivotal motion of the oar in a horizontal plane about the axis of tube 180. The balance provided by the spring 210 facilitates lifting and lowering of the oar during rowing, while the adjustment bolt 220 prevents the outer end of the oar from rising too far above the water level so that the oar acts as an outrigger to stabilize the boat in which it is mounted.

Figures 7, 8, 9:
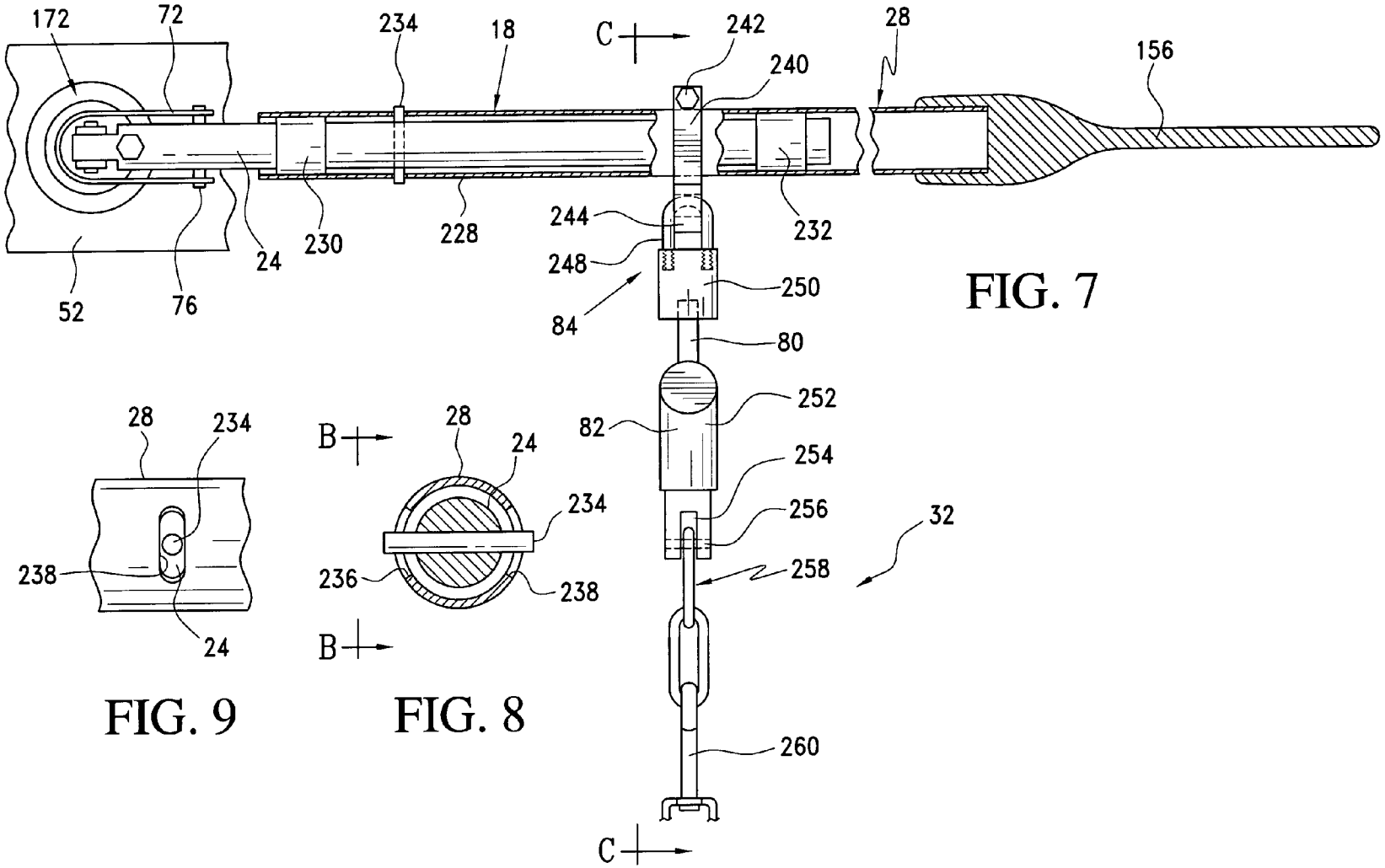
FIG. 7 is a top plan view of an oar utilized in the systems of FIGS. 1 and 2, illustrating a handle for manipulating the oar.
FIG. 8 is a cross-sectional view taken at lines AA and of the structure of FIG. 7.
FIG. 9 is a partial elevation taken at lines BB of FIG. 8.

The inner and outer ends 24 and 28 of oar 18 are illustrated in greater detail in FIGS. 7 through 9, to which reference is now made. It will be understood that oar 16 is substantially identical, and thus will not be described here. The outer portion 28 of the oar, which carries the oar blade 156 at its outermost end, is generally tubular, with its inner end 228 being coaxial with and telescoping over the inner shaft portion 24. Nylon bushings 230 and 232 are secured at spaced apart locations on the inner shaft 24 to receive the outer tube 28 to hold the tubes in coaxial alignment, and to facilitate rotation of the outer tube with respect to the inner tube. The inner tube may be of wood, metal, or the like, as desired, while the outer tube preferably is plastic, a metal such as aluminum, or other suitable material.

To prevent longitudinal motion between the inner and outer proportions 24 and 28, a pin 234 is secured in the oar portion 24 (see FIG. 8) and extends through elongated apertures 236 and 238 formed in the outer tube 28. The elongated apertures are vertically aligned and have a width substantially equal to or slightly greater than the diameter of pin 234 to prevent longitudinal motion of the outer tube with respect to the inner portion of the oar, while permitting relative rotation of the inner and outer oar portions 24 and 28. This arrangement allows the outer oar portion 28 to be rotated to feather or to square the oar blade 156, as described above, while the inner portion 24 of the oar provides pivotal support at pivot tower 172.

Figure 10:
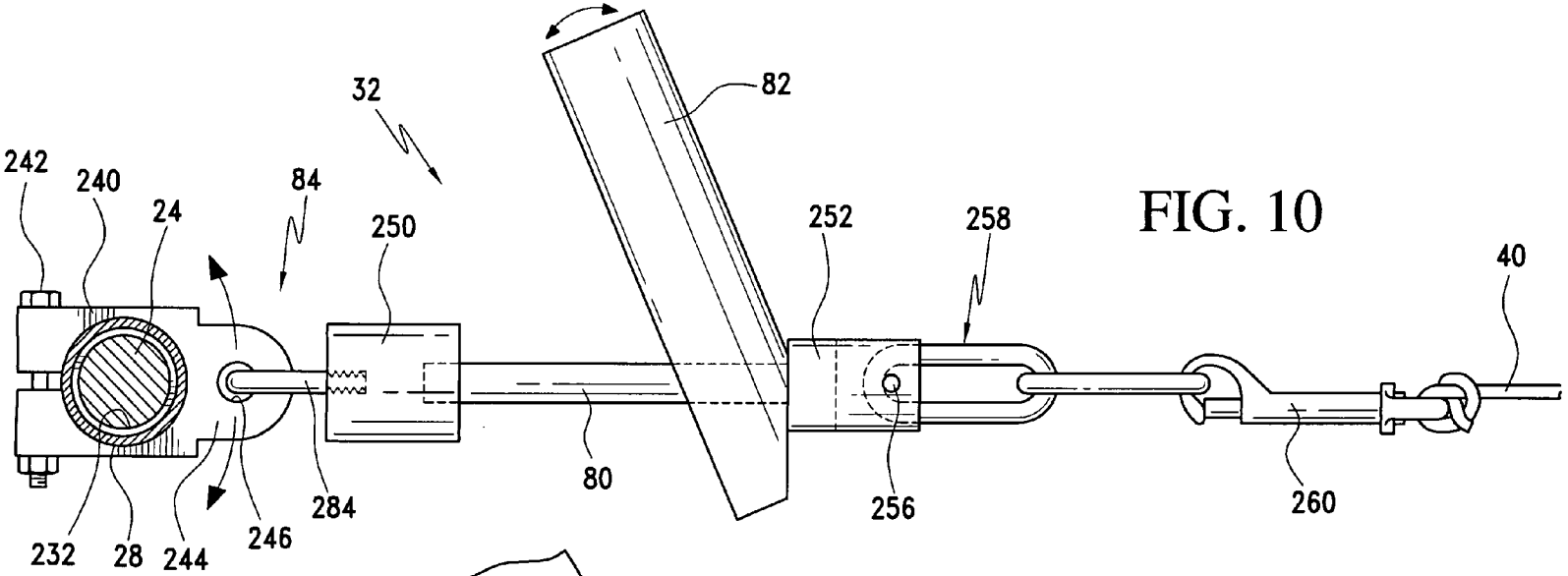
FIG. 10 is a cross-sectional view of the oar and handle of FIG. 7, taken at lines CC of FIG. 7A.

Rotation of the outer portion of the oar with respect to the inner portion is accomplished by handle 32, which is illustrated in greater detail in the top plan view of FIG. 7 and the side view of FIG. 10. As described with respect to FIG. 1, the handle 32 incorporates a rod 80 and a grip 82 connected to oar 18 through a pivotal connection 84 which may be in a form of a universal joint to allow relative motion between handle 32 and oar 18. The connection 84 may incorporate, for example, a clamp 240 secured to the outer oar tube 28 as by a clamping bolt 242. The clamp incorporates an ear portion 244 incorporating an aperture 246 that extends through the ear in a direction generally parallel to the oar 18. A pulling eye 248, which may be in the form of a stainless steel U-shaped bolt, passes through aperture 246 and is secured in a connecting block 250 which, in turn, is secured to an end of rod 80. The clamp 240 may be of nylon, while the block 250, the rod 80, and the pulling handle 82 preferably are of wood, with the parts being glued together with a suitable epoxy, or the like.

At the end of rod 80 adjacent and behind the grip 82 is a second connector block 252 which may also be secured to the end of rod 80, as by glueing. Connector 252 incorporates a rearward-facing slot 254 that receives a connecting pin 256 for securing the cable 44. A cable connector such as a length-adjustment chain 258 and a hasp 260 may be used to couple cable 44 to the handle. Chain 258 may be plastic, for example, and may be of an adjustable length suitable for connecting the cable 44 for transferring motion from boot 38 to the oar 18, in the manner described above. It will be understood that the handle 30 on oar 16 is substantially identical to the handle 32, and thus is not described here.

As described above, the handle 32 is rotated in clockwise or counter-clockwise directions by the rower to twist the outer oar portion 28 in a counter-clockwise or clockwise direction, respectively, to control the feathering of the blade, as discussed above.

As described with respect to FIGS. 1 and 2, movement of the oars is assisted by a pair of movable foot-operated shoes 36 and 38 connected to the oars by way of cables 42 and 44. This connection may be carried out by way of a suitable shoe harness, such as that illustrated at 114 in FIG. 1 for shoe 38. This harness incorporates a line 270 secured around the boot 38 and fastened, for example, to eyelets on the boot. Alternatively, the line may be secured to the sole of the boot near the ball of the foot of the user. The line 270 passes through opposite ends of a spanner 272 that is secured, in turn, to line 44. Another form of the harness is illustrated in FIG. 2 at 116, in which line 270 is secured to opposite ends of spanner 272. An eye 274 is secured to the spanner and the cable 44 is connected to the eye by means of clip 120, other methods for securing cable 44 to the boot 38 and for securing cable 42 to boot 36 will be apparent.

Figure 11:
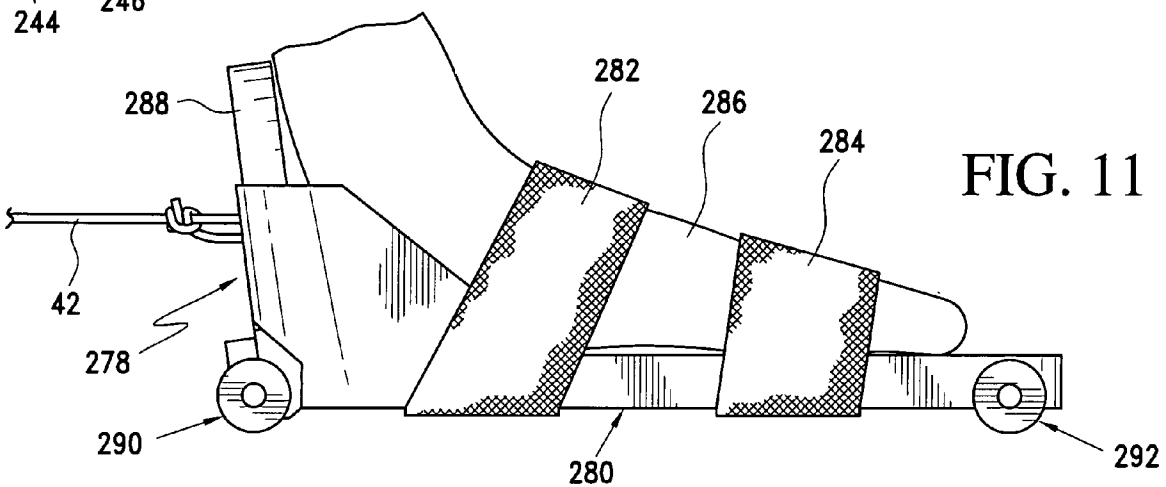
FIG. 11 is a side elevation of a wheeled movable shoe for use in the systems of FIG. 1 and FIG. 2.

In another embodiment of the invention, the shoes 36 and 38 may be in the form of a light weight wooden or plastic base 278 such as that illustrated in FIG. 11. The base includes a sole plate 280 sized to receive the foot of a rower, and may incorporate a pair of hook and loop fasteners 282 and 284 secured to the base and adjustable to extend over the rower's foot 286 to secure it. The base may include a heel portion 288 to which the cable 42, for example, may be fastened either by a harness similar to one of those illustrated in FIGS. 1 and 2, or by simply tying or otherwise securing the cable to the heel portion. In the illustrated embodiment, the shoe base 278 incorporates rear and forward sets of wheels 290 and 292 to facilitate the motion of the shoe along the floor 40 of the insert or along the floor surface of a boat hull in which the rowing assembly is mounted. These wheels may be of the type found on conventional roller blades or rollers skates, and may be of nylon or other suitable material.

Figure 12:
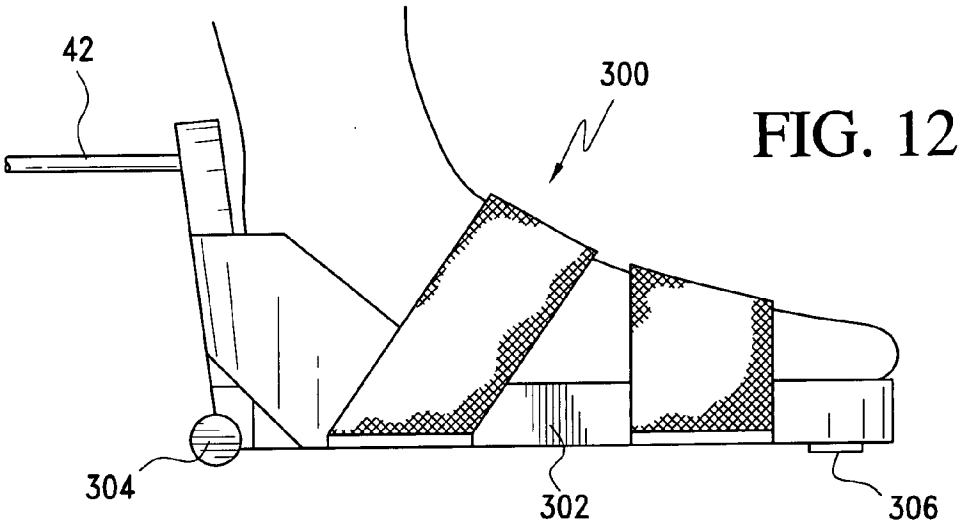
FIG. 12 is a side elevation of a movable shoe incorporating slides.
Figure 13:
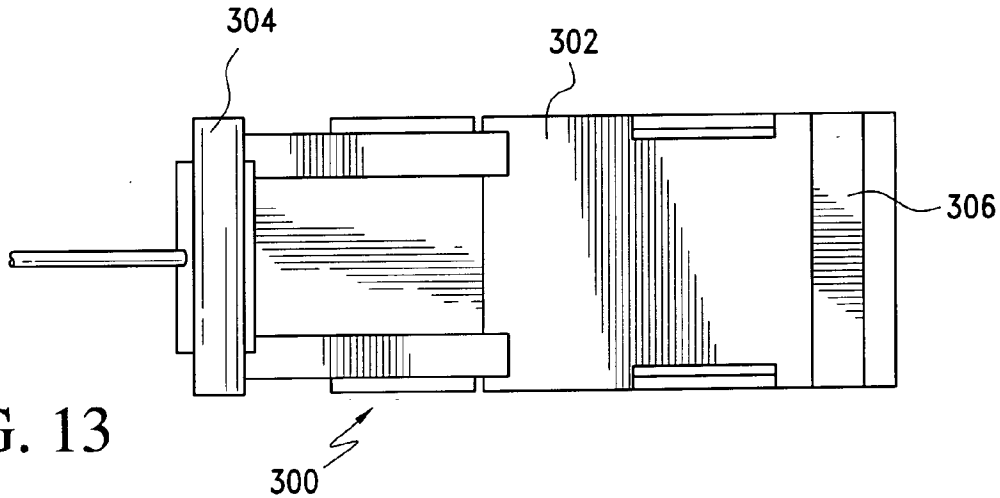
FIG. 13 is a bottom plan view of the shoe of FIG. 12.
Figure 14:
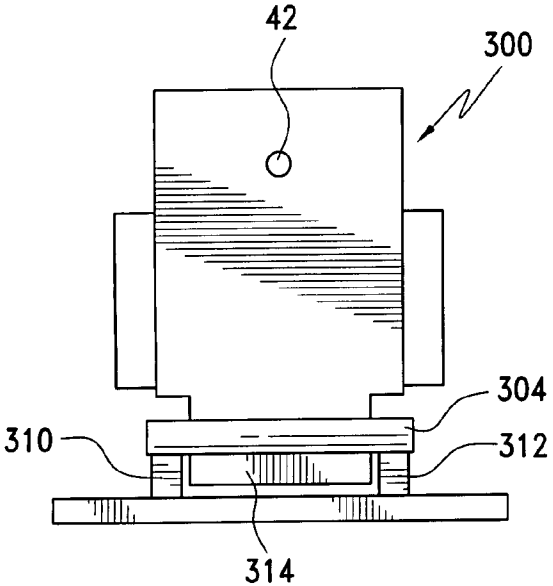
FIG. 14 is an end view of the shoe of FIG. 12.

Another embodiment of the shoes 36 and 38 is illustrated at 300 in FIGS. 12 and 13, FIG. 12 being a side elevation view, and FIG. 13 being a bottom view of the shoe. This shoe incorporates a base 302 which is similar to that illustrated in FIG. 11, the difference being that in place of wheels 290 and 292, a hardened stainless steel skid tube 304 is secured at the heel of the device and a stainless steel skid pad 306 is secured in the toe region of the device. The skid tube will slide on the floor 40 of the insert, or on the floor surface of the hull in which the system of the invention is installed to facilitate forward and rearward motion of the rower's feet.

In still another embodiment of the invention illustrated in FIG. 13, the stainless steel skid tube 304 may be extended across of a pair of tracks such as spaced oils impregnated nylon skids 310 and 312 fastened to the floor 40 of the insert or to the floor of the boat hull. A spacer 314 may be secured to the bottom of base 302 to fit between the skids 310 and 312 to guide the boot along the track. Similar tracks may also be used in combination with the wheel sets illustrated in FIGS. 1, 2 and 9, if desired.

Figure 15:
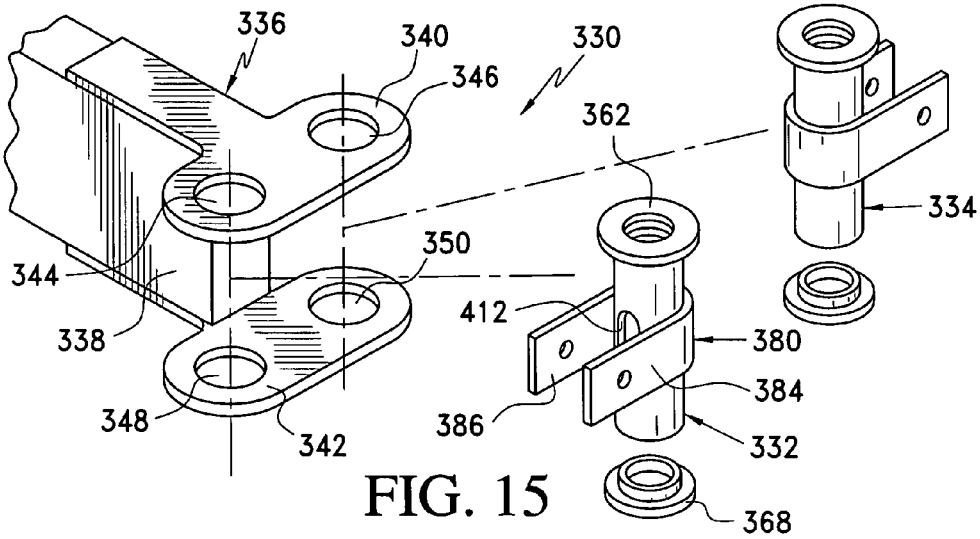
FIG. 15 is an exploded, partial view of another embodiment of the pivot mounting for the oars.
Figure 16:
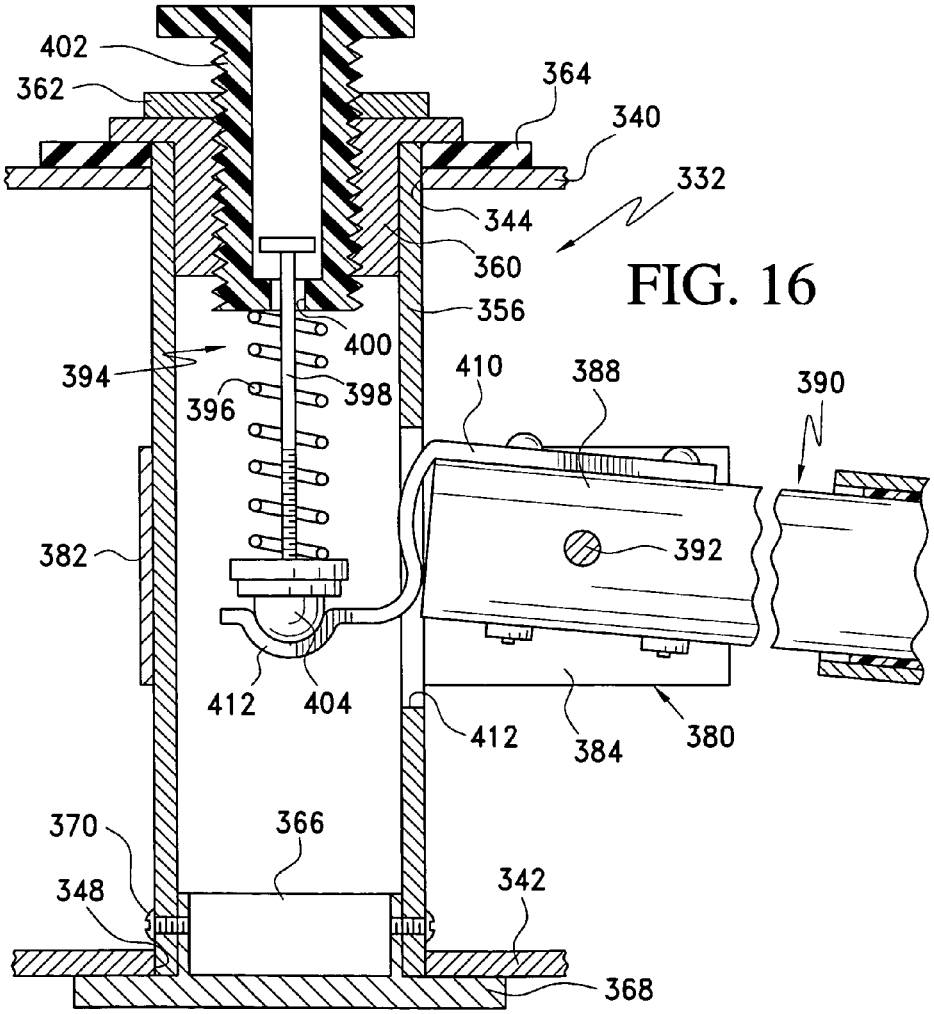
FIG. 16 is a cross-sectional view of the pivot mountings of FIG. 15.

Another embodiment of a pivot tower assembly 330 for pivotally supporting the oars for vertical and horizontal motion is illustrated in FIGS. 15 and 16, to which reference is now made. In this embodiment, the assembly 330 includes a pair of pivot towers 332 and 334 mountable in a pivot support platform 336. The platform may be secured to a cantilever arm 338 such as that illustrated at 60 in FIG. 2, or may be secured in a bridge structure of the type illustrated in FIG. 1. As illustrated, the support platform includes upper and lower spaced plates 34- and 342 secured at the end of arm 338. Apertures 344 and 346 are located in plate 340 and are vertically aligned with apertures 348 and 350, respectively, for receiving and rotatably holding, pivot tower 332 and 334. The towers are substantially identical, and will be described below with reference to pivot tower 332.

The pivot tower 332 is fabricated from a tube 356, which may be of stainless steel, aluminum, or other suitable material. The tube extends through the apertures 344 and 348 and is secured in place by an internally threaded plug 360 that is held in the tube by epoxy or other adhesive. The plug incorporates an outwardly extending flange 362 that extends beyond the top edge of the tube to rest on the top surface of plate 340. Preferably, a washer 364 of nylon or other suitable material is interposed between the flange 362 and plate 340 to facilitate rotation of the tube 356 with respect to plate 340.

The lower end of the tube 356 is secured in aperture 348 of lower plate 342 by a second plug 366 having an outwardly extending flange 368 which engages the lower surface of plate 342. Plug 366 may be secured in tube 356 by suitable fasteners such as screws 370.

A U-shaped bracket 380 is secured to tube 356, as by welding. The bracket has a closed end 382 which engages the tube and has a pair fo arms 384 and 386 which extend outwardly to receive and support the inner end 388 of an oar 390. The oar is secured between arms 384 and 386 by a pivot pin 392 which may be removable to allow the oar to be disconnected from the pivot tower. The pin allows motion of the oar in a vertical plane, while rotation of tube 356 allows motion of the oar in a horizontal plane.

The oar is counterbalanced by an adjustable mandrel 394 located in, and axially aligned with, the tube 356. The mandrel includes a coil spring 396 surrounding a central plunger 398 that is mounted for axial motion in the tube. The upper end of plunger 398 extends through a central aperture 400 in a guide plug 402 that is threaded into plug 360, so that the plunger is vertically movable in the guide plug. The upper end of the coil spring 396 engages the bottom of guide plug 401, while the lower end of the spring is held on the plunger by a suitable fastener such as an acorn nut 404. Tightening or loosening of the fastener 404 preloads the spring 396, and thus adjust the amount of force required to move plunger 398 upwardly into the guide plug 402.

A support bracket 410 is secured to the innermost end of the oar 390 and extends through an aperture 412 in tube 356. The bracket incorporates a detent 414 that engages the fastener 404 so that pivoted motion of the oar is counterbalanced by mandrel 394. The vertical locator of the mandrel and thus the rest position of the oar in the vertical plane, is adjustable by threading the guide plug 402 into or out of the tube 356, and vertical motion of the oar is limited by the top and bottom edges of the aperture 412.

As discussed above, in operation of the rowing system of the present invention, a rower moves his arms and body forward while lifting on the gripping handles 30 and 32. Wrist imparted lifting action on the gripping handles, together with water action on the oar blades, feathers the oar blades into a horizontal orientation. Releasing the pulling force on the oar, which has a downward component due to the relative height of the guide pulleys for cables 42 and 44, allows springs 210 to hold the oars horizontally without further arm support during the recovery part of the stroke. During the recovery, the height of the oar above the water is determined by adjustment of the preloaded spring. The forward, recovery motion of the oars is provided by forward body momentum transmitted through the arms and hands to the gripping handles 30 and 32 and then to the oar shafts. When large waves are present, keeping the oars out of the water by lifting the grip handles 30 and 32 is easy because of the spring-provided counterbalance. At the end of the recovery stroke the rower first rotates his wrists down to rotate the oar blades to squaring them. The grip handles 30 and 32 are then pushed down to "plant" the oar blades in the water with upright orientation. As soon as the oar is firmly "planted" the rower pulls with the arms and back and legs for the powering part of the stroke. The downward components of the pulling cables and a slightly non-vertical orientation of the oar blade, determined by the rotation limit of the pin 234 and slot 236 combination holds the oar at the proper depth in the water during this part of stroke without concentration by the rower.

The variable lengths of the connecting cables 42 and 44 and the movable seat 34 allow the system of the invention to be adjusted to a particular rower for comfort and for maximum efficiency. As a result, during the powering part of the stroke, the leg and arm and back motion are coordinated. The forces applied to the oars by the arms and back are independent of each other and these two forces add. In a conventional sliding seat rower the opposite is true, for these the force stress of the legs equals that of the arms. The consequence of this is that relative travel of the hands with conventional sliding seat rowing is almost double that of the forward facing rower disclosed herein. In conventional sliding seat rowing, the action of the legs, back and arms occur sequentially because of the relative strength of each. This leads to a lower stroke rate, for a given effort, than for the rowing apparatus disclosed herein, where the action of the legs and of the arms and back are simultaneous. The resulting intrinsically higher stroke rate of the rowing action is better matched to the body. It is generally accepted that an optimum stroke rate in a conventional sliding seat scull is around 25 strokes per minute; however, in the rower disclosed herein it is somewhat over 30 strokes per minute.

Although the invention has been described in terms of preferred embodiments, it will be understood that numerous modifications and variation may be made without departing from the true spirit and scope thereof, as set for in the following claims.

What is claimed is:

1. A leg-assisted forward rowing system, comprising:

a vessel to be propelled by a rower, said vessel having forward and rearward ends and a seat for a forward-facing rower between said ends;

an oar having an inner portion and having an outer blade portion rotatably mounted on the inner portion, the outer blade portion being controllably rotatable by the rower with respect to the inner portion to feather and square the blade portion of the oar;

a pivot mount on said vessel, the innermost end of said oar being pivotally mounted on said pivot mount so that the oar is movable by the rower for rearward motion toward said rearward end of said vessel in a power stroke to propel the vessel forwardly in the direction in which the rower faces when seated, and is movable by the rower for forward motion toward said forward end of the vessel in a return stroke;

a movable shoe positioned for linear reciprocal motion by a rower's foot along said vessel; and a connector extending between said movable shoe and said oar, whereby pivotal motion of said oars rearwardly in said power stroke is carried out by rearward motion of the rower's arms assisted by synchronous forward motion of said movable shoe by the rower.

2. The system of claim 1, wherein said movable shoe includes a roller engaging a surface in said vessel.

3. The system of claim 2, wherein said roller engages a floor surface of said vessel.

4. The system of claim 1, wherein said movable shoe includes a sliding surface engaging a surface in said vessel.

5. The system of claim 1, wherein said seat is stationary, and wherein said movable shoe engages and is reciprocably movable along a track in said vessel.

6. The system of claim 5, wherein said track is mounted on a floor surface of said vessel.

7. The system of claim 6, wherein said shoe includes rollers or sliders for engaging said track.

8. The system of claim 1, wherein said system is a unitary insert removably mountable in a vessel.

9. The system of claim 8, wherein said movable shoe includes a roller or slider engagable with a floor portion of said insert.

10. The system of claim 1, wherein said connector includes a flexible cable connected from said shoe, through a pulley, to said oar.

11. The system of claim 10, further including a handle pivotally connected to said oar for controllably rotating said oar.

12. The system for claim 11, wherein said cable is secured to said handle.

13. The system of claim 12, wherein said handle includes a rod portion having a pulling eye connected to said oar and a grip portion secured at an angle to said rod portion, whereby said rower grasps said grip portion to move said oar forwardly or rearwardly and to controllably rotate said rotatable end of said oar and engages said shoe with a foot to move the shoe reciprocally to assist the motion of said oar.

14. The system of claim 1, further including a pivot support mounted in said vessel between said seat and said forward end, said oar being mounted on said pivot support.

15. The system of claim 14, wherein said oar includes a first shaft portion having an end mounted on said pivot support and a second shaft portion mounted on and relatively rotatable with respect to said first shaft portion, and further including a handle pivotally connected to said second shaft portion for controllably pivoting and rotating said oar.

16. The system of claim 15, wherein said connector is a flexible cable connected at a first end to said handle and at a second end to said movable shoe.

17. The system of claim 16, wherein said seat is stationary.

18. The system of claim 17, further including a track in said vessel, said movable shoe being reciprocally movable along said track.

19. The system of claim 18 wherein said seat, said track and said pivot support comprise an insert mountable in said vessel.

20. The system of claim 14, wherein said pivot support comprises a tower incorporating a yoke for receiving an end of said oar, a pivot on said tower engaging said oar at a location spaced from said yoke, and an adjustable spring engaging said yoke for balancing said oar.

21. The system of claim 20, wherein said pivot engages said oar in a generally horizontal plane to permit pivotal motion of said oar in a vertical plane, and wherein said yoke is mounted in said tower to permit pivotal motion of said oar in said horizontal plane.

22. The system of claim 21, wherein said pivot support includes a platform, said tower being rotatably mounted in said platform.

23. The system of claim 21, wherein said yoke includes a vertical shaft extending into said tower, and wherein said adjustable spring is a coil spring mounted around said shaft and is adjustably compressible to balance said oar.

24. The system of claim 23, further including an adjustable limit device for said oar.

25. In a forward rowing system, an oar comprising:

a first shaft portion having a longitudinal axis and having a first end portion connectable to a vessel for vertical and horizontal motion;

a second shaft portion mounted on said first shaft for relative rotation about the longitudinal axis of said first shaft, said second shaft portion including a blade;

a handle pivotally mounted on said second shaft portion for controllably pivoting said oar for producing rowing motion of the oar, and for controllably rotating said second shaft portion for feathering said blade during such rowing motion.

26. The oar of claim 25, wherein said handle comprises a rod portion having a pulling eye connected to a clamp eye mounted on said second shaft portion of said oar, and a grip portion secured at an angle to said rod portion, whereby a rower can grasp said grip portion to move said oar horizontally and vertically in a rowing motion and can simultaneously tilt said rod portion to controllably rotate said second portion to control the feathering of said blade.

27. The oar of claim 26, further including a connector link on said handle for connected said oar to a foot-operated rowing assist shoe.

28. A forward facing rowing method, comprising:

providing an oar having a first portion pivotally mounted for rowing motion in horizontal and vertical directions about a pivot, having a second portion coaxial with and rotatable with respect to said first portion, and having a handle pivotally mounted on said second portion;

moving said oar about said pivot by said handle;

controllably rotating said second portion of said oar with respect to said first portion by pivoting said handle to feather and square the oar during rowing; and connecting said handle to a foot-operated shoe that is relatively movable with respect to said pivot and with respect to a relatively stationary seating position for assisting said rowing.

29. The method of claim 28, wherein rowing is carried out by a rower seated at said stationary seating position and substantially simultaneously pulling on said handle and pushing on said shoe to provide a power stroke, by pushing on said handle to provide a return stroke, and by pivoting said handle to rotate said second portion of the oar between a squared position during the power stroke and a feathered position during the return stroke.

30. The method of claim 29, wherein the seating position and the pivot are fixed in a vessel to be rowed, and wherein rowing includes pivoting said handle synchronously with the motion of said oar and said shoe during power and return strokes to propel the vessel in the direction faced by the seated rower.

31. The method of claim 30, wherein the power stroke includes lowering the oar and simultaneously pivoting the handle in a first direction to rotate the oar to a squared position and thereafter simultaneously pulling the handle and pushing the shoe.

32. The method of claim 31, where the return stroke includes raising the oar and simultaneously pivoting the handle in a second direction to rotate the oar to a feathered position, and thereafter simultaneously pushing the handle and pulling the shoe.

* * * * *